US007607803B2

(12) United States Patent
Zhang et al.

(10) Patent No.: US 7,607,803 B2
(45) Date of Patent: Oct. 27, 2009

(54) LED LAMP

(75) Inventors: Wen-Xiang Zhang, Shenzhen (CN); Guang Yu, Shenzhen (CN); Cheng-Tien Lai, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 72 days.

(21) Appl. No.: 12/037,100

(22) Filed: Feb. 26, 2008

(65) Prior Publication Data

US 2009/0154168 A1 Jun. 18, 2009

(30) Foreign Application Priority Data

Dec. 14, 2007 (CN) ..... 2007 1 0125125

(51) Int. Cl.
*F21V 29/00* (2006.01)

(52) U.S. Cl. ..... 362/294; 362/298; 362/305; 362/373

(58) Field of Classification Search ..... 362/296, 362/298, 301, 302, 305, 294, 373, 240, 245, 362/246, 345

See application file for complete search history.

(56) References Cited

U.S. PATENT DOCUMENTS

| | | | | |
|---|---|---|---|---|
| 6,183,100 | B1 * | 2/2001 | Suckow et al. | 362/35 |
| 6,613,288 | B2 * | 9/2003 | Gupte | 422/125 |
| 6,854,208 | B1 * | 2/2005 | Chuang et al. | 43/125 |
| 6,871,983 | B2 * | 3/2005 | Jacob et al. | 362/364 |
| 7,093,952 | B2 * | 8/2006 | Ono et al. | 362/194 |
| 7,160,010 | B1 * | 1/2007 | Chinniah et al. | 362/511 |
| 7,178,937 | B2 * | 2/2007 | McDermott | 362/187 |
| 2003/0231488 | A1 * | 12/2003 | Albee | 362/96 |
| 2004/0264185 | A1 * | 12/2004 | Grotsch et al. | 362/231 |

* cited by examiner

*Primary Examiner*—Ali Alavi
(74) *Attorney, Agent, or Firm*—Frank R. Niranjan

(57) ABSTRACT

An LED lamp includes a frame, a heat sink, an LED module and a reflector. The frame comprises a base, an upper ring spaced from the base and a plurality of stanchions connecting the upper ring and the base together. The heat sink is coupled to a top of the upper ring and covers a whole of a top of the frame. The LED module is attached to a bottom surface of the heat sink and surrounded by the upper ring. The reflector is placed on the base and has an outer surface facing and slantwise to the LED module. The reflector has a configuration like an inverted funnel. The outer surface of the reflector has multiple steps formed thereon.

19 Claims, 4 Drawing Sheets

LED LAMP

BACKGROUND OF THE INVENTION

1. Field of the Invention

The present invention relates to an LED lamp for a lighting purpose, and more particularly to an improved LED lamp providing soft light having even brightness. Furthermore, the LED lamp has a good heat dissipation capability so that the LED lamp can be used for a long time with a good illumination quality.

2. Description of Related Art

An LED lamp is a type of solid-state lighting that utilizes light-emitting diodes (LEDs) as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

Known implementations of LED modules in an LED lamp make use of a plurality of individual LEDs to generate light that is sufficient and of satisfactory spatial distribution. The large number of LEDs leads to a more expensive module and one with greater power consumption. The greater power usage leads to greater heat output, which, if not adequately addressed at additional expense, impacts the LED lamp reliability.

Besides, since the LEDs are generally arranged on a printed circuit board which having a flattened surface, the LEDs acting as a light source and arranged in this way usually are failed to provide a three-dimensional, soft lamplight with even brightness that is required for some applications, for example, a park lamp or a decorative lamp.

What is needed, therefore, is an improved LED lamp which can overcome the above problems.

SUMMARY OF THE INVENTION

An LED lamp, includes a frame, a heat sink, an LED module and a reflector. The frame comprises a base, an upper ring spaced from the base and a plurality of stanchions connecting the upper ring and the base together. The heat sink is coupled to a top of the upper ring and covers a whole of a top of the frame. The LED module is attached to a bottom surface of the heat sink and surrounded by the upper ring. The reflector is placed on the base and has an outer surface facing and being slantwise to the LED module. The reflector has an inverted funnel-like shape with a hollow pipe extending upwardly toward a center of the LED module. The outer surface of the reflector is configured into a multiple-stepped sections, whereby light generated by the LED module can be reflected by the reflector in every directions to radiate out of the LED lamp. Accordingly, the LED lamp can have a soft light with an even brightness. Furthermore, heat generated by the LED module is absorbed by the heat sink to be dissipated into ambient air, whereby the LED lamp can reliably generate light for a sufficiently long period of time.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
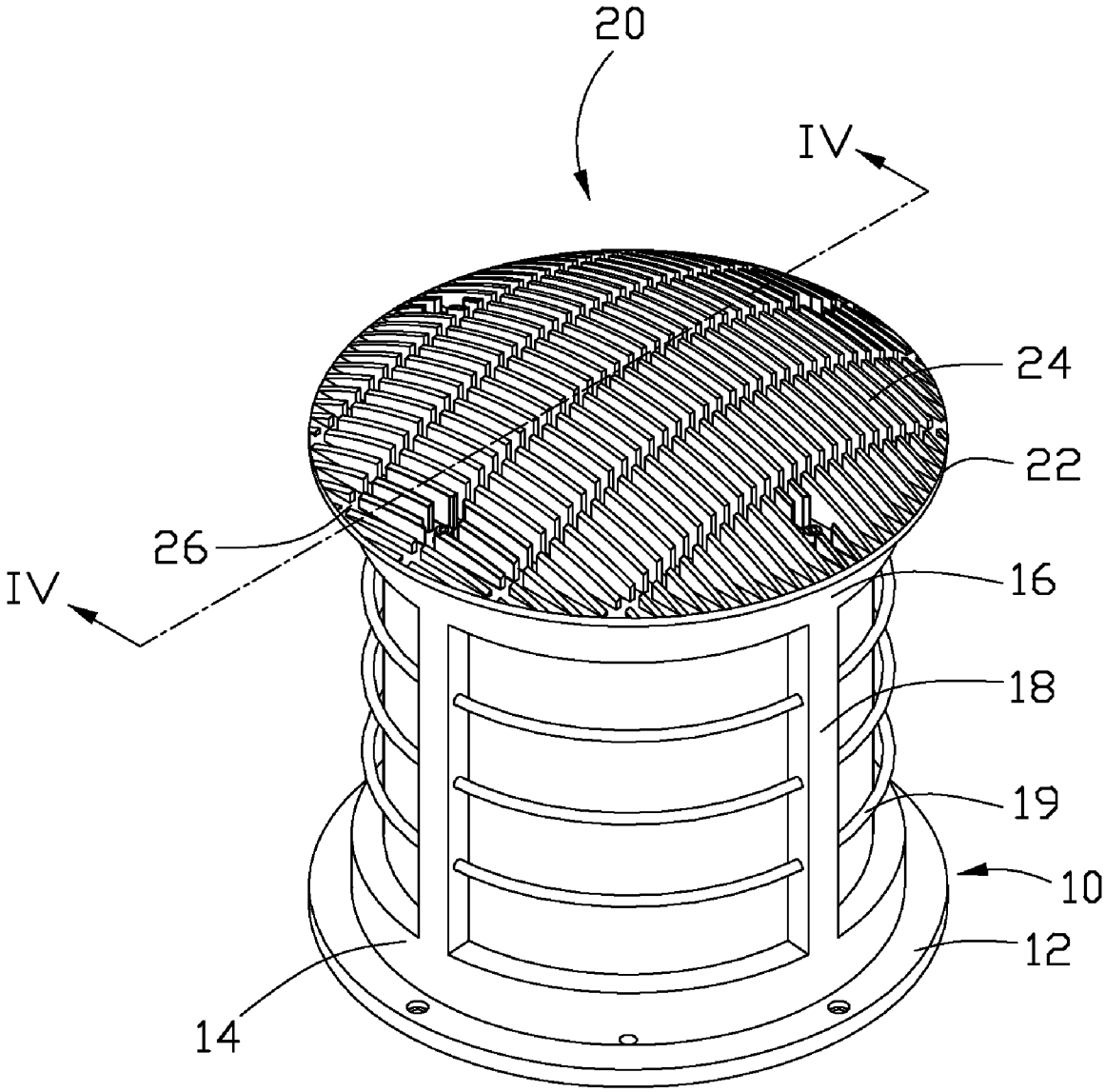
FIG. 1 is an isometric, assembled view of an LED lamp in accordance with a preferred embodiment of the present invention.
Figure 2:
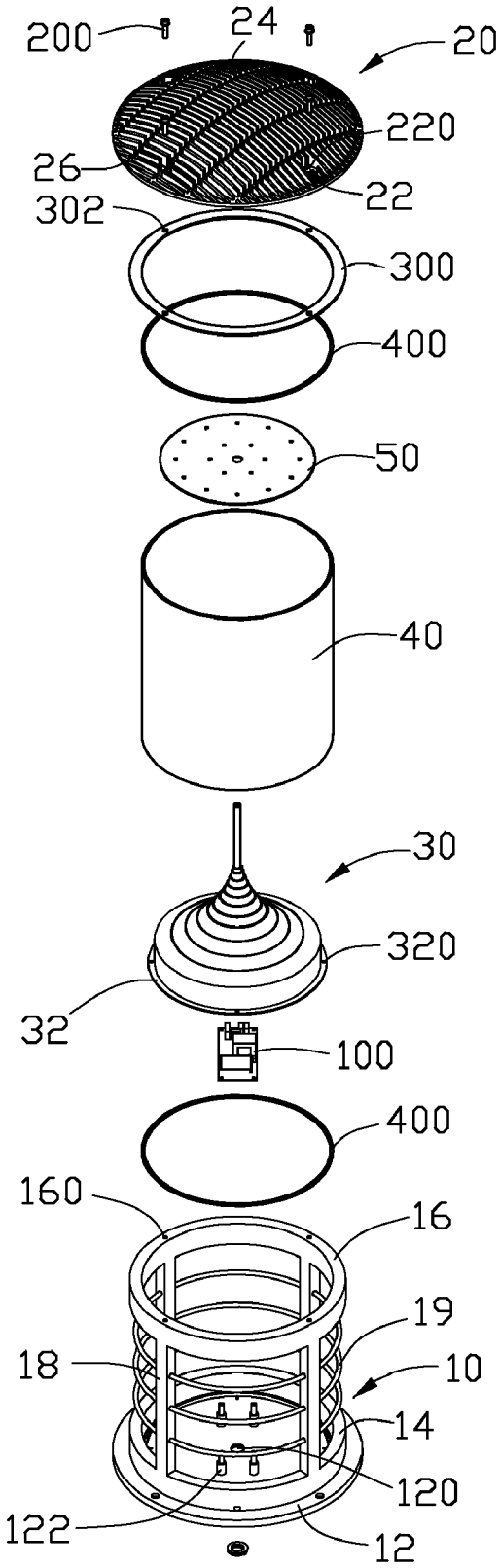
FIG. 2 is an exploded view of FIG. 1.
Figure 3:
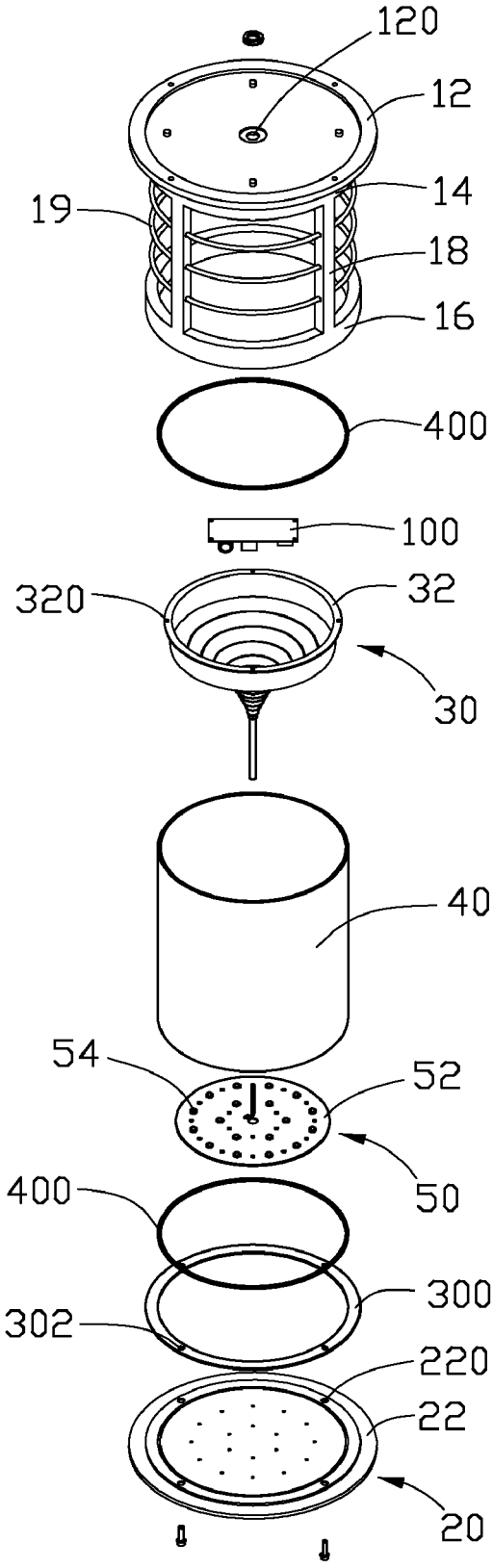
FIG. 3 is an inverted view of FIG. 2.

Referring to FIGS. 1-3, an LED lamp in accordance with a preferred embodiment is illustrated. The LED lamp comprises a frame 10, a heat sink 20 disposed on the frame 10, an LED module 50 attached to a bottom surface of the heat sink 20, a reflector 30 disposed in the frame 10, and an envelope 40 fitly received in the frame 10 and surrounding the reflector 30.

The frame 10 is formed integrally and configured to provide a solid support of the LED lamp. The frame 10 comprises a circular plate-shaped base 12, a lower ring 14 extending upwardly from a top surface of the base 12, an upper ring 16 spaced from the lower ring 14 and a plurality of vertical stanchions 18 connecting the lower and the upper rings 14, 16 together. The base 12 defines a holding hole 120 in a centre thereof, for extension of lead wires into the LED lamp and receiving a lamp holder to hold the LED lamp in position. Four fixing posts 122 surrounding the holding hole 120 extend upwardly from a top surface of the base 12 and define securing orifices (not labeled) therein for securing a rectifier 100 on the base 12. The lower ring 14 is averagely adjacent to a rim of the base 12 and has a diameter slightly smaller than that of the base 12. The upper ring 16 which is parallel to the lower ring 14 is equal to the lower ring 14 in size and defines a plurality of engaging orifices 160 in a top thereof for engagingly receiving screws 200. The stanchions 18 are rectangular shafts and perpendicular to the lower and upper rings 14, 16. A plurality of circular wires 19 which are parallel to the lower ring 14 extend through the stanchions 18 and encircle a circumference of the frame 10 to protect the envelope 40 from outside damage.

The heat sink 20 is integrally formed of a metal with a good heat conductivity such as aluminum, copper or alloy thereof. The heat sink 20 is mounted on a top of the upper ring 16 and comprises a circular plate 22 and a plurality of fins 24 arranged on the plate 22. The fins 24 are parallel to each other and extend perpendicularly from a top surface of the plate 22. A plurality of spaced channels 26 is defined in and perpendicular to the fins 24 for facilitating airflow taking heat away from the fins 24 into ambient air. The channels 26 cut the fins 24 into a plurality of similar sections. Corresponding to the engaging orifices 160 in the upper ring 16, a plurality of through holes 220 is defined in the plate 22. The screws 200 are brought to extend through the through holes 220 to threadedly engage in the engaging orifices 160 to thereby fix the heat sink 20 to the top of the frame 10.

The reflector 30 is disposed in the frame 10 and covers the rectifier 100 on the base 12. In this embodiment, the reflector 30 has a shape substantially like an inverted funnel with a hollow pipe (not labeled) extending upwardly toward a center of the LED module. A fixing flange 32 extends horizontally from a bottom edge of the reflector 30 and defines a plurality of fixing orifices 320 therein for fixtures (not shown) extending therethrough to engage into the base 12. A plurality of steps (not labeled) that are parallel to the base 12 of the frame 10 are formed on an outer surface of the reflector 30. The outer surface of the reflector 30 faces and is slantwise to the LED module. Moreover, the outer surface of the reflector 30 is centrosymmetrical relative to a central axis thereof.

The envelope 40 is tube-shaped and made of transparent or semitransparent material such as glass and colophony. The envelope 40 is configured to be snugly received in the frame 10 and cling to an inner wall of the frame 10. When received in the frame 10, a top end of the envelope 40 levels with the top of the upper ring 16 of the frame 10.

Particularly referring to FIG. 3, the LED module 50 includes a circular printed circuit board 52 and a plurality of LEDs 54 mounted on the printed circuit board 52.

Figure 4:
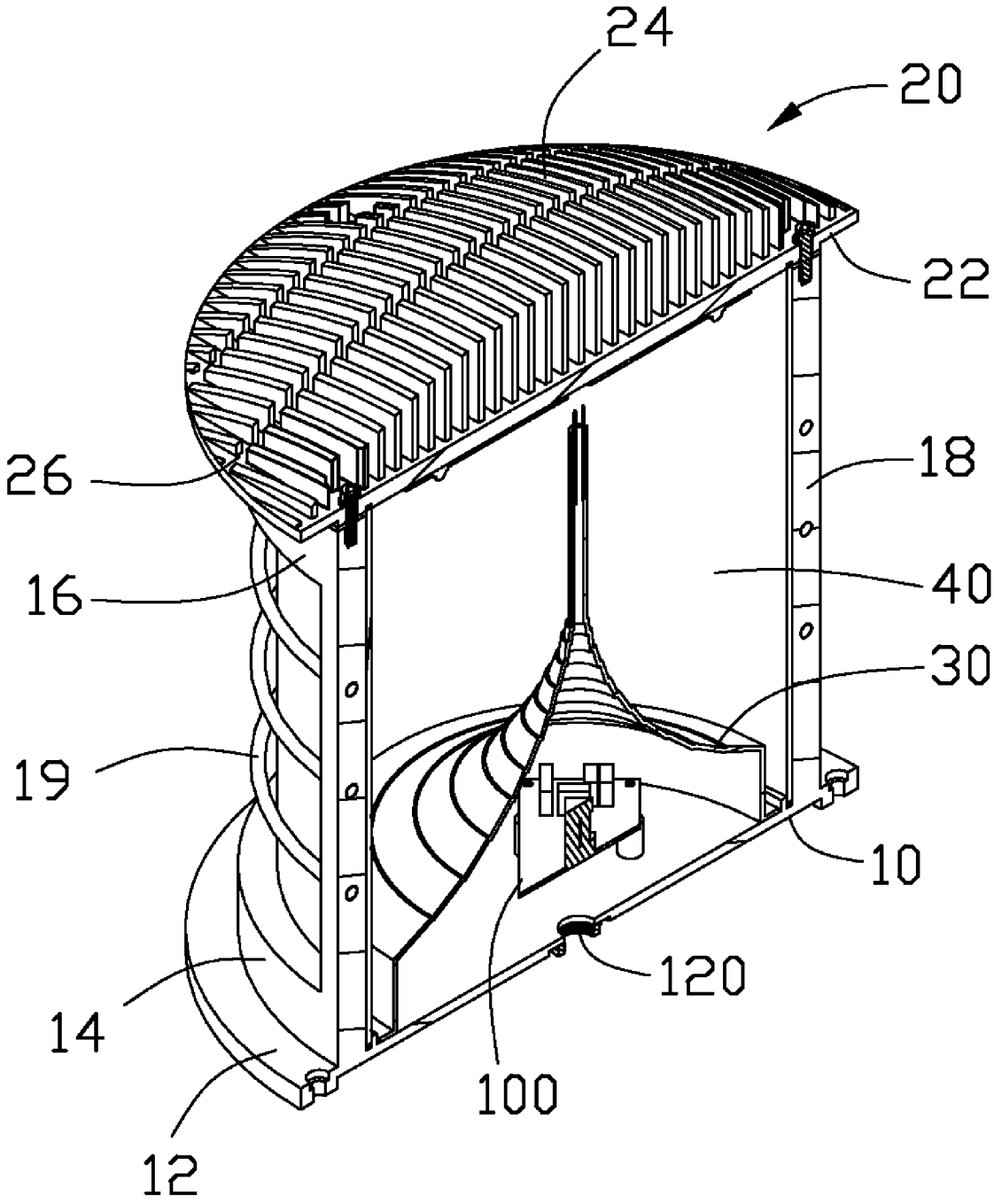
FIG. 4 is a cross-section view of FIG. 1, taken along line IV-IV thereof.

Also referring to FIG. 4, in assembly of the LED lamp, the reflector 30 is secured on the top of the base 12 of the frame 10 by the fixtures extending through the fixing orifices 320 and screw into the base 12. The envelope 40 is snugly received in the frame 10 and surrounds the reflector 30. The heat sink 20 with the LED module 50 attached to the bottom surface thereof is fixed on the top surface of the frame 10 by the screws 200 extending through the through holes 220 in the plate 22 of the frame 10 to screw into the engaging orifices 160 in the top of the frame 10. In order to prevent rainwater from creeping into the LED lamp when the LED lamp is used outdoors, a waterproof cushion 300 is used. The waterproof cushion 300 has through orifices 302 defined therein, for extension of the screws 200 through the waterproof cushion 300. The waterproof cushion 300 is provided to be tightly sandwiched between the frame 10 and the heat sink 20. A lower gasket 400 is provided to be tightly sandwiched between a bottom of the envelope 40 and the top surface of the base 12 of the frame 10. An upper gasket 400 is provided to be tightly sandwich between the bottom surface of the heat sink 20 and a top of the envelope 40.

In use of the LED lamp, light generated by the LED module 50 can be reflected omnidirectionally toward outside of the frame 10 by the outer surface of the reflector 30. Thus, the light is soft and has an even brightness. Therefore, the LED lamp according to the present invention can be used as a park lamp or a decorative lamp which requires a more uniform and tender illumination. Since the outer surface of the reflector 30 is slantwise to the LED module 50, the light emitted from the planar LED module 50 can be reflected in multidimensionality, which increases the illumination area of the LED lamp. Heat generated by the LED module 50 is absorbed by the plate 22 of the heat sink 20 and then delivered to the fins 24 to be dissipated into ambient air. The LED module 50 is thus cooled and works within allowable temperature range. Besides, the heat sink 20 located on the top of the frame 10 can serve as a protective cover for protecting the LED lamp. In the present invention, lead wires can extend from the rectifier 100 upwardly through the hollow pipe of the reflector 30 to electrically connect with the LED module 50.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp, comprising:

a frame comprising a base, an upper ring spaced from the base and a plurality of stanchions connecting the upper ring and the base together;

a heat sink coupled to a top of the upper ring and covering a whole of a top of the frame;

an LED module attached to a bottom surface of the heat sink and surrounded by the upper ring; and a reflector placed on the base, having an outer surface facing and being slantwise to the LED module.

2. The LED lamp as claimed in claim 1, wherein the outer surface of the reflector is centrosymmetrical relative to a central axis thereof.

3. The LED lamp as claimed in claim 1, wherein the reflector is inverted funnel-shaped.

4. The LED lamp as claimed in claim 3, wherein a plurality of steps is formed on the outer surface of the reflector.

5. The LED lamp as claimed in claim 4, wherein a fixing flange extends horizontally from a bottom edge of the reflector and defines a plurality of fixing orifices therein, adapted for fixtures extending therethrough to engage into the base.

6. The LED lamp as claimed in claim 1, wherein a lower ring corresponding to the upper ring extends upwardly from the base.

7. The LED lamp as claimed in claim 6, wherein the base is a circular plate, and the stanchions perpendicularly connect the upper and the lower rings.

8. The LED lamp as claimed in claim 1, wherein the frame is further provided with a plurality of circular wires parallel to the base, extending through the stanchions and encircling along a circumference of the frame.

9. The LED lamp as claimed in claim 1, wherein the heat sink comprises a plate and a plurality of fins extending upwardly from the plate, and the LED module is attached to a bottom surface of the plate.

10. The LED lamp as claimed in claim 9, wherein the plate is circular and defines a plurality of through holes therein, and a plurality of screws extend through the through holes and screw into the upper ring.

11. The LED lamp as claimed in claim 9, wherein the fins are spaced from and parallel to each other, and a plurality of spaced channels is defined in the fins and perpendicularly cuts the fins into a plurality of sections.

12. The LED lamp as claimed in claim 9, further comprising a waterproof cushion which is sandwiched between a top of the upper ring and the bottom surface of the plate.

13. The LED lamp as claimed in claim 1, further comprising a tube-shaped envelope which is snugly received in the frame and surrounds the reflector.

14. The LED lamp as claimed in claim 13, further comprising an upper gasket which is sandwiched between a top end of the envelope and the bottom surface of the heat sink, and a lower gasket which is sandwiched between a bottom end of the envelope and the base of the frame.

15. The LED lamp as claimed in claim 1, wherein the LED module comprises a circular printed circuit board and a plurality of LEDs mounted on the printed circuit board.

16. An LED lamp comprising:

a frame having a base, an upper ring and a stanchion interconnecting the base and the upper ring;

an inverted funnel-shaped reflector received in the frame and fixed to the base, the reflector has a multiple-stepped outer surface;

a heat sink fixedly attached to a top of the upper ring; and an LED module attached to a bottom surface of the heat sink; wherein light generated by the LED module is reflected by the outer surface of the reflector to radiate out of the lamp.

17. The LED lamp as claimed in claim 16, wherein the reflector has a hollow pipe extending upwardly toward a center of the LED module.

18. The LED lamp as claimed in claim 16 further comprising an envelope fittingly received in the frame and enclosing the reflector.

19. The LED lamp as claimed in claim 16 further comprising a rectifier received in the reflector.

* * * * *